US005533431A

United States Patent [19]

Schickling

[11] Patent Number: 5,533,431

[45] Date of Patent: Jul. 9, 1996

[54] CUTTING RULE

[76] Inventor: Robert A. Schickling, 727 E. Clements Bridge Rd., Runnemede, N.J. 08078

[21] Appl. No.: 294,914

[22] Filed: Aug. 24, 1994

[51] Int. Cl.[6] ..... B26D 1/36; B26D 1/40

[52] U.S. Cl. ..... 83/347; 82/854

[58] Field of Search ..... 83/660, 698.41, 83/347, 835, 854; 493/64, 73, 74

[56] References Cited

U.S. PATENT DOCUMENTS

| | | | |
|---|---|---|---|
| 2,956,465 | 10/1960 | Mingo | 83/660 |
| 3,795,163 | 3/1974 | Armstrong et al. | 83/660 |
| 3,841,189 | 10/1974 | Spengler et al. | 83/660 |
| 4,027,390 | 6/1977 | Kendzior | 83/835 |
| 4,135,421 | 1/1979 | Bertram et al. | 83/854 |
| 5,001,956 | 3/1991 | Nitsch | 83/660 |
| 5,174,186 | 12/1992 | Baba et al. | 83/698.41 |

*Primary Examiner*—Kenneth E. Peterson

*Attorney, Agent, or Firm*—Norman E. Lehrer; Jeffrey S. Ginsberg

[57] ABSTRACT

A method for cutting sheet material such as corrugated cardboard with a die cutter so as to reduce the amount of paper dust produced. The die cutter of the present invention utilizes a cutting rule having a base section and a cutting section. The cutting rule is characterized by a plurality of serrated teeth extending from the cutting section of the cutting rule. Each tooth terminates in a point and has a beveled side face. Formed between adjacent teeth is a semi-circular notch. The notches extend into the cutting section.

5 Claims, 2 Drawing Sheets

CUTTING RULE

BACKGROUND OF THE INVENTION

The present invention is directed toward a method of cutting sheet material such as corrugated cardboard, and more particularly to such a method utilizing a cutting rule having a series of serrated teeth with notches therebetween for reducing the amount of paper dust from the severed cardboard.

Devices for cutting corrugated cardboard or other similar material are well known in the art. A commonly used device is the rotary die cutter. The rotary die cutter employs a cutting rule mounted on a rotating die cylinder. In operation, the cutting rule cuts through the cardboard and into a rotating anvil cylinder. The anvil cylinder is preferably covered with a resilient layer of material such as polyurethane or rubber. The teeth of the cutting rule form indentations in the anvil cover.

Many known die cutters are deficient in that a large amount of paper dust is created when the cutting rule severs the corrugated board. Paper dust creates a number of problems. For example, the paper dust ends up covering the finished product. It also interferes with printing inks that may be applied to the cardboard. In addition, the build up of the dust can lead to maintenance problems in the die cutting machine. Last but not least, the paper dust creates discomfort to workers operating the machine as it gets in their eyes and breathing passages.

Another common problem with known die cutters is that fibers from the severed corrugated board tend to become ingrained in the indentations in the anvil cover. See, for example, U.S. Pat. Nos. 3,277,764 and 3,203,295. The impregnation of fibers in the anvil cover results from the type of cutting rule that is utilized. As the serrated teeth of the cutting rule initially pass into the corrugated board, cardboard fibers located between the teeth remain. However, the wedging action of the cutting rule, as it passes through the cardboard, fractures the fibers that connect the board parts. The fibers from the severed corrugated board tend to become ingrained in the indentations in the anvil cover. The entrapped fibers eventually break apart the anvil cover. Accordingly, after a relatively short period of use the anvil cover has to be replaced. This requires the machinery to be shut off thereby creating costly downtime. Furthermore, replacement of the anvil cover itself is expensive.

Both U.S. Pat. Nos. 3,277,764 and 3,203,295 claim to minimize the build up of cardboard fibers in the anvil cover through the use of novel cutting rules. In U.S. Pat. No. 3,277,764, the cutting edge of the cutting rule comprises a plurality of equispaced sharp points separated by arcuate scallop-like cutting portions. As the cutting rule severs the workpiece, fibers located between the scallop-like cutting portions are severed by the aforementioned sharp points. Therefore, the fibers are free to become embedded in the indentations in the anvil cover. Similarly, in U.S. Pat. No. 3,203,295 the entire length of the cutting edge cuts through the workpiece. Again, this leads to the formation of a substantial amount of paper dust since no material is left between the cut pieces of corrugated board. See, also, U.S. Pat. No. 2,596,851.

Accordingly, there is a need for a method of cutting sheet material that limits the amount of paper dust created from the severed cardboard and minimizes the frequency in which the anvil cover requires replacement.

SUMMARY OF THE INVENTION

The present invention is designed to overcome the deficiencies of the prior art discussed above. This is accomplished by providing a method of cutting corrugated cardboard that minimizes the amount of paper dust created and limits the build up of cardboard fibers in the anvil cover of a die cutter.

In accordance with the illustrative embodiments, demonstrating features and advantages of the present invention, there is provided a method for cutting corrugated cardboard with a die cutter. The die cutter of the present invention employs a cutting rule having a base section and a cutting section. The cutting rule is characterized by a plurality of serrated teeth extending from the cutting section of the cutting rule. Each tooth terminates in a point and has at least one beveled side face. A semi-circular notch is formed between adjacent teeth.

The cutting rule also includes a plurality of slots formed in the base section to facilitate the bending of the cutting rule so that a predetermined cutting line can be achieved on the corrugated board.

During the cutting operation, the teeth pass through the corrugated board and into the anvil cover. The cardboard fibers located between the teeth remain. This is due to the fact that the notches formed between adjacent teeth extend into the cutting section passed the roots of the teeth. The fibers are not severed from the board parts since no part of the cutting section contacts the fibers. Rather, the fibers remain attached to one part of the cardboard. Therefore, a reduced amount of paper dust is created during the cutting process. Moreover, the anvil cover does not have to be replaced as frequently as less fibers are free to become ingrained in the indentations in the anvil cover.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
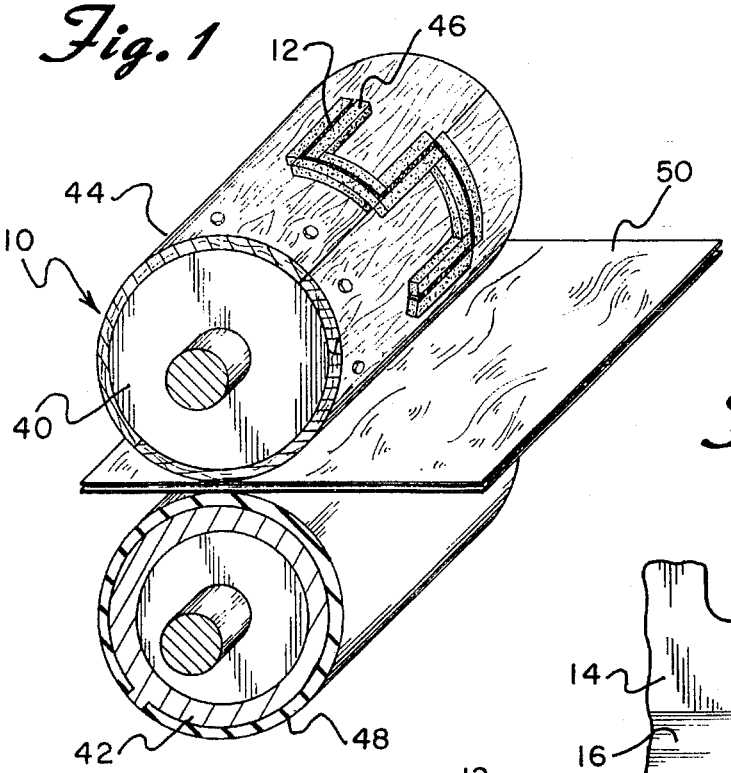
FIG. 1 is a partial view of the rollers of a rotary die cutter employing a cutting rule constructed in accordance with the principles of the present invention.

Referring now to the drawings in detail wherein like reference numerals have been used throughout the various figures to designate like elements, there is shown in FIG. 1 a rotary die cutter 10 employing a cutting rule 12 constructed in accordance with the principles of the present invention. Although the present invention is described in connection with a rotary die cutter, it should be understood that the method of cutting corrugated cardboard is equally applicable to other types of devices such as a die press.

Figure 2:
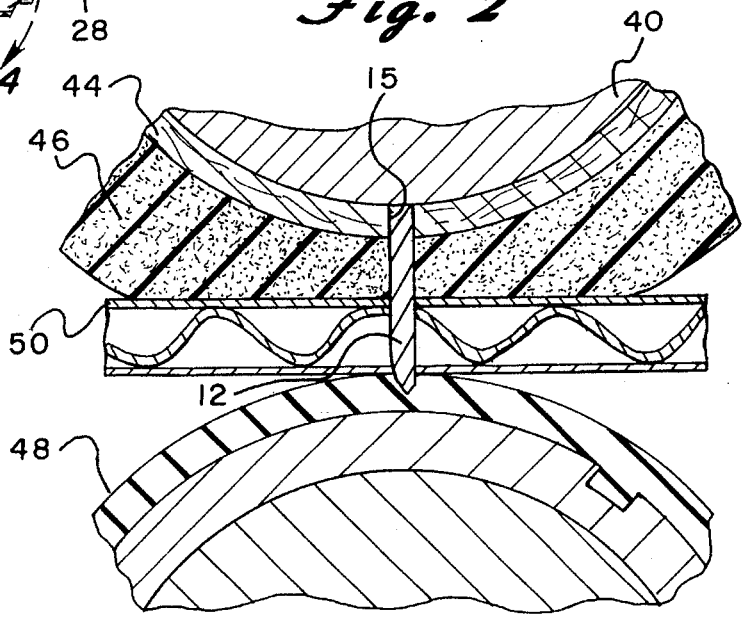
FIG. 2 is a partial cross-sectional side view of the rollers, corrugated board and the cutting rule.

As with other similar rotary die cutters, the present invention includes a die cylinder 40, an anvil cylinder 42 and a cutting rule 12. A rigid covering 44 is secured around the die cylinder 40. Preferably, the rigid covering 44 is made of wood. The cutting rule 12 is friction fit into grooves 15 formed in rigid covering 44 as shown in FIG. 2. Sections of stripper material 46 are secured around the periphery of cutting rule 12. The stripper material 46 extends upwardly passed the cutting section 16 of the cutting rule 12 as shown in FIG. 1. The stripper material is preferably made of an elastic material such as foam rubber and, in the known manner, acts to prevent cut board 50 from sticking to cutting rule 12. An anvil cover 48 is secured around anvil cylinder 42. Cover 48 is preferably made of polyurethane, however it can be made of a variety of other materials.

Figure 4:
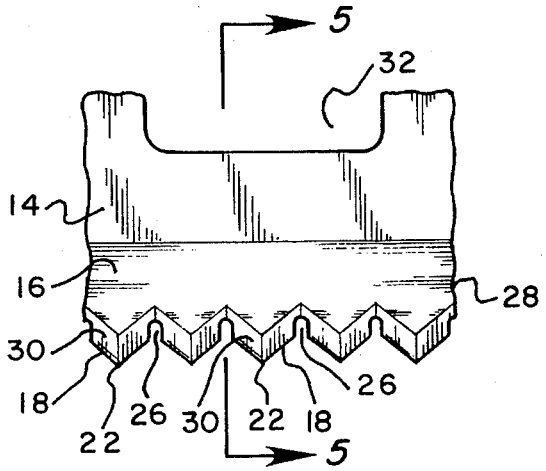
FIG. 4 is an enlarged view of the encircled portion shown in FIG. 3.
Figure 3:
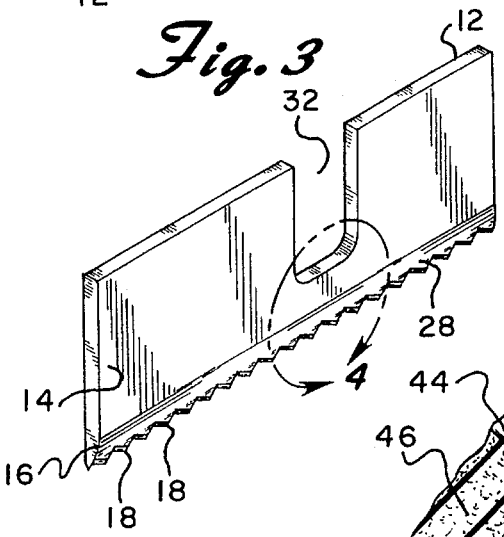
FIG. 3 is a perspective view of the cutting rule.
Figure 5:
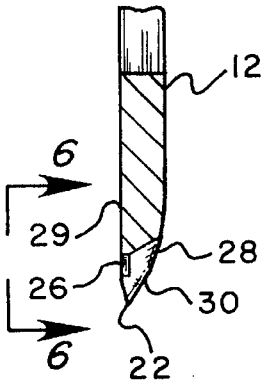
FIG. 5 is an enlarged sectional view taken along lines 5–5 of FIG. 4.
Figure 6:
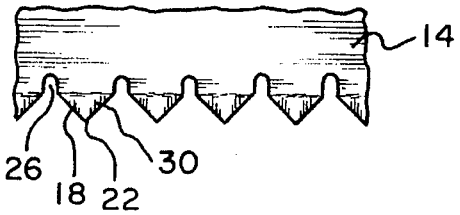
FIG. 6 is partial side view of the cutting rule taken along lines 6–6 of FIG. 5.

The cutting rule 12 of the present invention is comprised of a base section 14 and a cutting section 16 as illustrated in FIGS. 3 and 4. The cutting section 16 is integral with the base section 14. The cutting section has a beveled side 28 and a flat side 29 (see FIG. 5).

A plurality of serrated teeth 18 extend from the cutting section 16. Each tooth 18 terminates in a point 22. A notch 26 is formed between each of the teeth 18. In the preferred embodiment, notches 26 are semi-circular in shape. Notches 26 extend into the cutting section 16 passed the serrated teeth 18 on flat side 29. Each tooth 18 has a beveled side face 30 on beveled side 28 of cutting section 16 for wedging apart the corrugated board 50 when the cutting section 16 of cutting rule 12 is forced into the corrugated board. In an alternate embodiment, both sides of cutting section 16 and both side faces of teeth 18 are beveled.

In the preferred embodiment, the base section 14 has a plurality of slots 32 formed therein (see FIGS. 3 and 4). The slots 32 facilitate the bending of the cutting rule 12 so that the cutting rule can be formed in a desired curved shape before being mounted in the rigid covering 44. In addition, the slots decrease the amount of material that must be removed from the rigid covering 44. More specifically, grooves do not have to be formed in the rigid covering 44 along the length of the slots 32 when the cutting rule is mounted therein.

To facilitate an understanding of the principles associated with the foregoing process and apparatus, its operation will now be briefly described. A sheet of corrugated cardboard 50 is fed between die cylinder 40 and anvil cylinder 42 of rotary die cutter 10. In the preferred embodiment, the distance between cylinders, 40 and 42, is approximately equivalent to the thickness of the sheet of corrugated cardboard 50. The rotation of the cylinders causes the cardboard 50 to pass through the die cutter 10.

Figure 7:
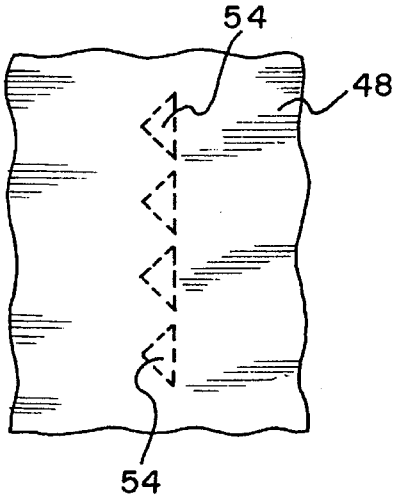
FIG. 7 is a partial view of the anvil cover showing, in phantom, the indentations made by the cutting rule.

The stripper material 46 and the anvil cylinder 42 exert pressure on the corrugated cardboard 50 (or other material being cut) to prevent shifting while the cutting rule 12 is entering the material during the cutting operation. As the cardboard moves through the rotary die cutter, the stripper material 46 is compressed and the cutting rule 12 is forced against the cardboard 50. The teeth 18 on cutting section 16 pass through the board 50 and move into the anvil cover 48 thereby making indentations 54 therein as shown in FIG. 7. When the cutting rule 12 moves out of the corrugated board 50, the stripper material 46 expands to prevent the board from adhering to the cutting rule.

Figure 8:
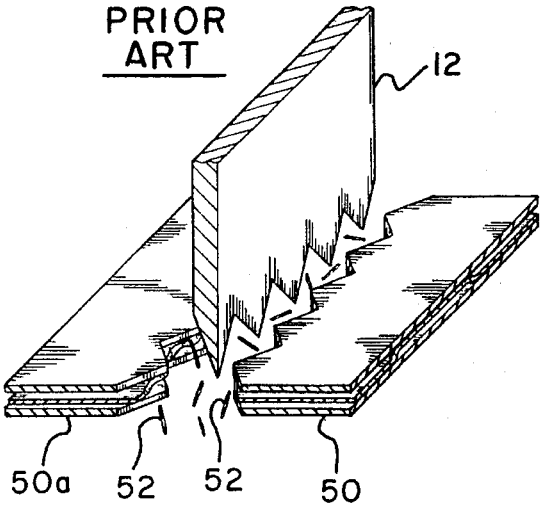
Fig. 8 PRIOR ART
FIG. 8 is a perspective view of a prior art cutting rule shown cutting the fibers between two pieces of corrugated board.

During the cutting process, fibers are formed between the teeth of the cutting rule. The fibers are created as a result of the wedge-shaped cutting rule pulling the board sections apart. With prior art cutting rules, the fibers formed between the teeth are severed by the cutting rule as the rule passes through the cardboard as shown in FIG. 8. The fractured fibers 52 are either embedded in the anvil cover 48 or are randomly dispersed, as paper dust, in and around the rotary die cutting machine. The accumulation of paper dust in the anvil cover 48 eventually causes the cover to break apart. Accordingly, the life of the anvil cover is significantly reduced.

Figure 9:
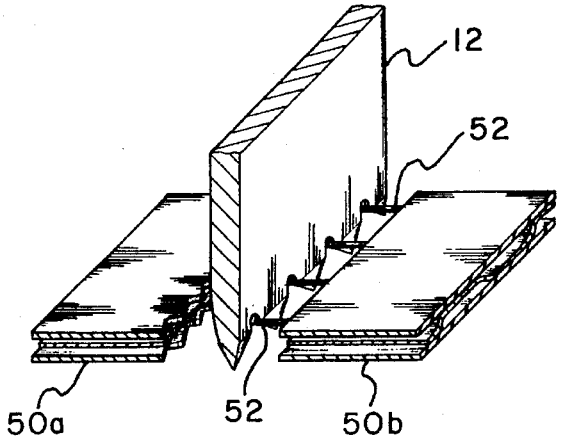
FIG. 9 is a partial perspective view of the cutting rule of the present invention in use and cutting a corrugated board.

The cutting rule 12 of the present invention is designed to prevent the removal of the cardboard fibers 52 formed between pieces **50*a* and 50*b* of the corrugated cardboard (see FIG. 9). This is achieved by forming semi-circular notches 26 between each tooth 18. When the cutting section 16 of cutting rule 12 enters the sheet of corrugated cardboard 50, the beveled side faces 30 of teeth 18 wedge apart the cardboard sheet 50. The teeth pass into the anvil cover 48. Fibers 52 are formed between pieces 50*a* and 50*b* of the corrugated cardboard. Since the notches extend into the cutting rule passed the serrated teeth 18, the fibers are not contacted by any part of the cutting rule. Therefore, the fibers remain on one part of the severed cardboard, as shown in FIG. 9**, instead of being randomly dispersed as paper dust.

During the removal of the cutting rule 12 from the anvil cover 48, the stripper material 46 expands up passed the teeth 18 thereby removing cardboard fibers from the cutting rule created during the cutting procedure. This reduces fiber buildup on the cutting rule 12 which would otherwise result in failure of the cutting rule.

The present invention may be embodied in other specific forms without departing from the spirit or essential attributes thereof and accordingly reference should be made to the appended claims rather than to the foregoing specification as indicating the scope of the invention.

I claim:

1. In a rotary die cutter for facilitating the separating of a cardboard sheet into separate pieces, said die cutter having a rotating die cylinder, a cutting rule mounted on said die cylinder and an anvil cylinder having a compressible material secured thereto, wherein the improvement comprises said cutting rule having a base section and a cutting section, said cutting section being integral with said base section and having a beveled side and a plurality of teeth, each of said teeth having a pair of beveled side faces on said beveled side of said cutting section, said cutting section further having a plurality of notches, each of said notches being formed in said beveled side faces of two adjacent teeth and being located entirely within said beveled side faces.

2. The die cutter of claim 1 wherein each of said notches is semi-circular in shape.

3. The die cutter of claim 1 wherein said base section has a plurality of slots formed therein for allowing said cutting rule to bend.

4. The die cutter of claim 3 wherein said cutting section has a pair of opposing beveled sides.

5. The die cutter of claim 4 wherein each of said teeth has a pair of beveled side faces on each of said beveled sides of said cutting section.

* * * * *